US006300715B1

(12) United States Patent
Clerc

(10) Patent No.: US 6,300,715 B1
(45) Date of Patent: Oct. 9, 2001

(54) VERY HIGH POWER RADIOFREQUENCY GENERATOR

(75) Inventor: Guy Clerc, Thonon les Bains (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/502,337

(22) Filed: Feb. 11, 2000

(30) Foreign Application Priority Data

Feb. 16, 1999 (FR) ..... 99 01859

(51) Int. Cl.[7] ..... H01J 23/18

(52) U.S. Cl. ..... 315/5.37; 315/5.32; 315/5.44; 330/44; 330/45; 331/79; 331/82

(58) Field of Search ..... 315/5.37, 5.32, 315/5.44; 330/44, 45; 331/79, 82

(56) References Cited

U.S. PATENT DOCUMENTS

| | | | | |
|---|---|---|---|---|
| 4,429,250 | | 1/1984 | Clerc et al. | 313/336 |
| 4,563,609 | | 1/1986 | Clerc et al. | 313/343 |
| 4,577,134 | | 3/1986 | Clerc | 313/346 R |
| 5,233,269 | * | 8/1993 | Lien | 315/5.37 |
| 5,313,138 | | 5/1994 | Desmur | 315/3 |
| 5,650,751 | * | 7/1997 | Symons | 330/45 |
| 5,682,084 | | 10/1997 | Langlois et al. | 315/5.32 |
| 5,828,165 | | 10/1998 | Clerc et al. | 313/346 R |
| 5,936,335 | | 8/1999 | Clerc | 313/346 R |
| 6,084,353 | * | 7/2000 | Bohlen | 315/5.32 |

OTHER PUBLICATIONS

Patent Abstracts of Japan, vol. 017, No. 125 (E–1332), Mar. 16, 1993, JP 04 301341, Oct. 23, 1992.

Patent Abstracts of Japan, vol. 018, No. 063 (E–1500), Feb. 2, 1994, JP 05 276754, Oct. 22, 1993.

* cited by examiner

*Primary Examiner*—Don Wong
*Assistant Examiner*—Jimmy T. Vu
(74) *Attorney, Agent, or Firm*—Oblon, Spivak, McClelland, Maier & Neustadt, P.C.

(57) ABSTRACT

The disclosure relates to a radiofrequency generator including an Inductive Output Tube with an electron gun followed by an anode, the gun being raised to a high voltage in use, means producing an input radiofrequency signal and means of transmitting it to said IOT such that it provides an output signal whose power is amplified compared to said input signal, wherein said means producing said input radiofrequency signal, said means transmitting it to said IOT and said gun are confined in an electrostatically screened enclosure that is electrically isolated from the potential of the anode and can be raised to a high voltage, said gun receiving its high voltage from said screened enclosure. The invention is applicable to very high power radiofrequency generators.

18 Claims, 3 Drawing Sheets

VERY HIGH POWER RADIOFREQUENCY GENERATOR

BACKGROUND OF THE INVENTION

The invention relates to radiofrequency generators of very high power. These generators, used notably for scientific applications, must operate at frequencies of the order of 20 to 200 MHz, or even slightly higher, and in a pulsed regime provides peak powers of several tens of megawatts. In the continuous regime the powers are significantly lower.

DESCRIPTION OF THE PRIOR ART

These generators make use of vacuum tubes. At these frequencies classical grid tubes such as tetrode-type tubes are limited to a few megawatts of power, the present limit being about 10 MW.

Klystrons can supply these powers but they work at microwave frequencies, in other words much higher frequency.

Inductive Output Tubes (IOT) are used in the frequency range of the grid tubes at much smaller powers; they are mainly used in UHF television transmitters. They are configured as shown in FIG. 1. By adapting their input and output resonant circuits to the desired frequency they can also be used at shortwave and VHF frequencies. These tubes would appear to be the most suitable to obtain the required performance since they are derived from klystron technology.

Nonetheless, they still present certain problems. An IOT has an axial electron beam and applies the principle of amplitude modulation on its input, as in classical grid tubes; the output uses the axial structure of speed modulation tubes, as in klystrons.

More precisely, the tube contains successively an electron gun 1 built around an axis of revolution XX' and along the axis an anode 5 forming the first drift tube 5 which opens into an interaction space 6 of a single output resonant cavity 7, the interaction space 6 being delimited by a second drift tube 8 axially facing the first drift tube 5, then a collector 15. The two rims of the drift tubes lie axially opposite each other. The gun 1 includes a cathode 2, a heating filament 3 and a grid 4. The cathode 2/grid 4 space forms the input circuit and the routing of the input signal E to the input circuit of the tube is generally via a coaxial resonant input cavity 9 coupled to the cathode/grid space. The input signal E to be amplified is introduced into the cavity 9 by looped inductive coupling means in the embodiment described. This input signal E is supplied by means external to the tube, generally including a preamplifier (not shown).

The grid 4 and cathode 2 are raised to continuous high negative voltages and the electrons emitted by the cathode emerge from the grid 4 in the form of a beam 10 in packets already modulated in density by the input signal E, contrary to what happens in a klystron. The beam 10 is longitudinal, following the axis XX'. The electrons of the beam 10, attracted and focused by the anode 5, penetrate the output cavity 7 and traverse the interaction space 6 where they couple to the electromagnetic field of the resonant cavity 7. An output signal S of power significantly higher than that of the input signal E can be extracted from this output cavity 7. The electrons having lost most of their energy then impinge on the wall of the collector 15. The anode 5 is generally grounded; the collector 15 may also be grounded or at a slightly different potential from the ground.

When the IOT is intended to work with a modulated output power, as in television stations broadcasting transmitters, the input signal E carries the modulation. The coaxial input cavity 9, formed of two coaxial conducting cylinders 90, 91 is generally provided with a device 11 to regulate its resonant frequency, for example of the type including a piston whose position is adjustable. For safety reasons and to decouple the preamplifier from the high tension, this coaxial input is grounded. A decoupling capacitor C1 provides electrical isolation, from a continuous point of view, between the internal cylinder 90 and the cathode 2 and another decoupling capacitor C2 provides electrical isolation between the outer cylinder 91 and the modulation grid 4. These capacitors C1, C2 can be made of insulating sheets squeezed respectively between a cavity cylinder 90, 91 and a cylindrical part 13, 16 connected respectively to the electrode 2, 4.

In this application, as a UHF transmitter, the high tensions are of the order of a few tens of kilovolts, the cathode being less negative than the grid.

The output signal S, of amplified power compared with the input signal E, is extracted from the output cavity 7 by capacitive or inductive coupling. In FIG. 1, inductive coupling is shown in the form of a conductor 12 making a loop in the output cavity 7. The output signal is passed to a user device such as an antenna (not shown).

The inside of the tube is classically under vacuum. Sealing of the output cavity 7 is assured by a dielectric sleeve 14 which allows the energy to be extracted to pass. Part of the output cavity 7 is external. It is delimited by walls in contact with the sleeve on the side where there is no vacuum.

Klystrons, operating either continuously or in pulses, can produce high powers because the gun is raised to high tension whereas the input signal to be amplified is injected into the first cavity of the tube. There is no interference between the high tension and the signal to be amplified.

In lOTs, on the other hand, the input signal to be amplified is injected in the cathode-grid space and the cathode and grid are simultaneously raised to high voltages. To obtain the required output powers (several tens or even hundreds of megawatts), the high tensions are no longer of a few tens of kilovolts but as much as a few hundred kilovolts. In these conditions, the capacitors between the two walls of the coaxial input cavity and respectively the cathode and the grid, of the same type as those in FIG. 1, will be ineffective. Decoupling becomes difficult to achieve because the risk of breakdown is very high owing to the very high voltages and small dimensions of the components.

SUMMARY OF THE INVENTION

The present invention resolves this problem and reduces the risks of breakdown. For this purpose, the invention includes an enclosure that is electrostatically screened and electrically isolated from the potential of the anode and that serves to confine the means producing the signal to be amplified (which is applied to the cathode/grid space), the means to passing it to the gun, and the gun of the IOT; this surrounding screened enclosure is connected to the means producing the high tension. With this structure the means of decoupling, between the input resonant circuit and either the grid or the cathode, that were the source of the problem described above, become unnecessary.

More precisely, the invention is a radiofrequency generator including an Inductive Output Tube (IOT) with an electron gun followed by an anode, the gun being raised to a high voltage in use, means producing an input radiofrequency signal, and means of transmitting it to said IOT such that it provides an output signal whose power is amplified compared to said input signal, wherein said means producing said input radiofrequency signal, said means transmitting it to said IOT and said gun are confined in an electrostatically screened enclosure that is electrically isolated from the potential of the anode and can be raised to a high voltage, said gun receiving its high voltage from said screened enclosure.

For safety reasons, the anode is generally grounded (i.e. at ground potential) and the screened enclosure can be placed on at least one dielectric support on the floor.

The means used to produce the input radiofrequency signal can include a radiofrequency source which feeds a preamplifier producing the input radiofrequency signal.

The means to deliver the input radiofrequency signal to the IOT can include an input resonant circuit connected between the grid and the cathode of the tube.

The resonant circuit may be with distributed or localized constants, this choice depending notably on the frequency chosen.

The means producing the input signal to be amplified can receive electrical power from the secondary of at least one isolating transformer, one point of which is connected to the screened enclosure, its primary being connected to ground. The primary of the transformer can be outside the screened enclosure and the secondary inside it.

If the generator is intended to work in a pulsed regime (in which case the high tension is pulsed), the means producing the input signal to be amplified may be fed by at least one battery placed inside the screened enclosure to limit the effects of parasitic signals generated by the edges of the voltage pulses.

The cathode of the IOT is preferably electrically connected to the screened enclosure. The grid is then polarized with respect to the cathode by means of a polarization source placed in the screened enclosure.

The heating device can receive the power it needs via the secondary of at least one isolating transformer of which one point is connected to the screened enclosure, the primary being connected to ground. The primary of the transformer can be outside the screened enclosure and the secondary inside it.

The isolating transformers can be combined in a single unit.

In inductive output tubes, the anode ends with a lip which, in combination with a second lip placed opposite it, delimits an interaction space for the electrons produced by the gun, this interaction space being coupled to an output resonant circuit from which the output signal is extracted.

The output resonant circuit can be with distributed or localized constants.

To avoid problems relating to the high tension, it is preferable to provide optical means to control the input signal to be amplified and/or the heating device.

BRIEF DESCRIPTION OF THE DRAWINGS

Other characteristics and advantages of the invention will become evident on reading the description below of embodiments, which are non-limitative and taken only as examples, with reference to the attached drawings of which.

DESCRIPTION OF PREFERRED EMBODIMENTS

Figure 2:
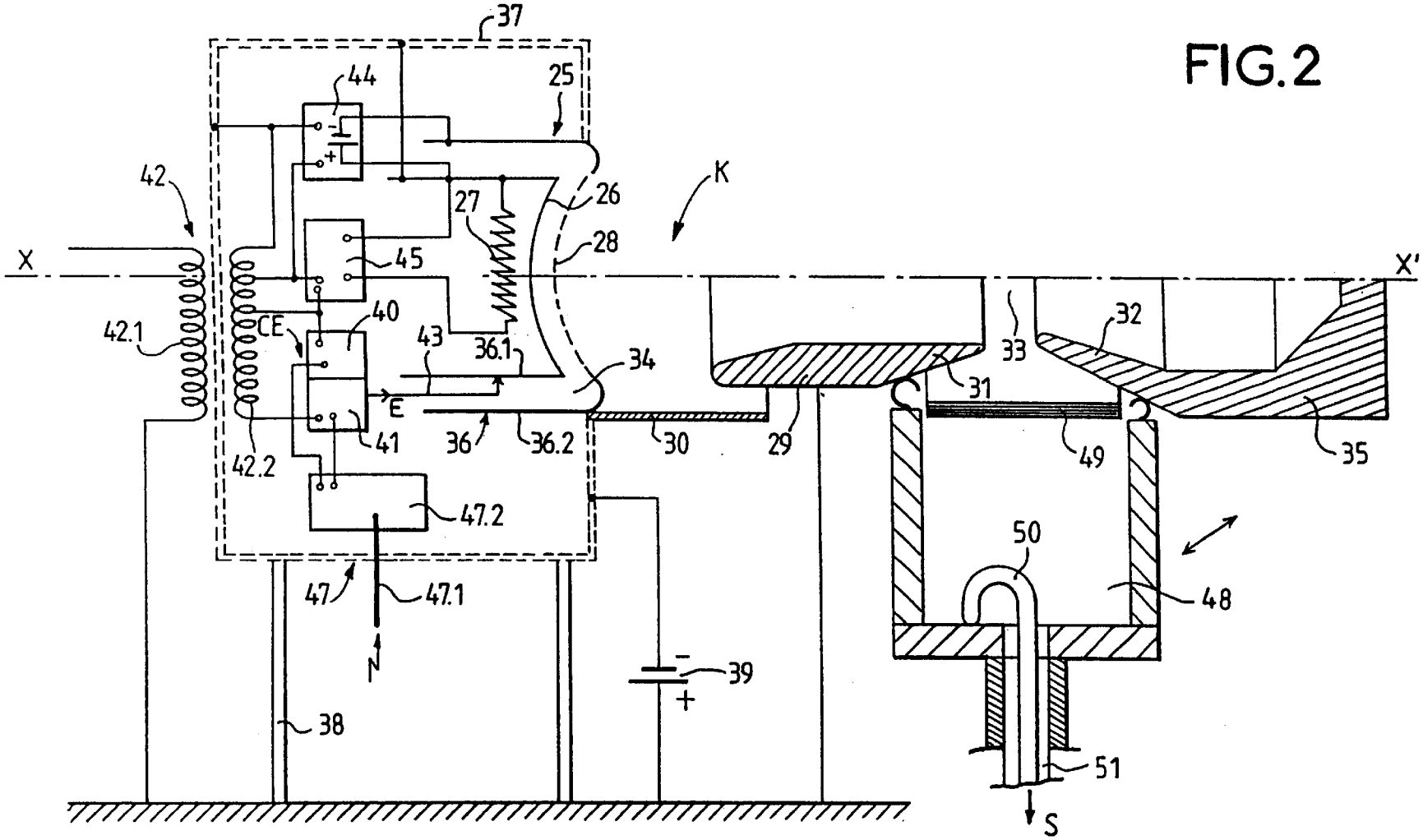
FIG. 2 shows a partial longitudinal section of a radiofrequency generator according to the invention, including a IOT.
Figure 3:
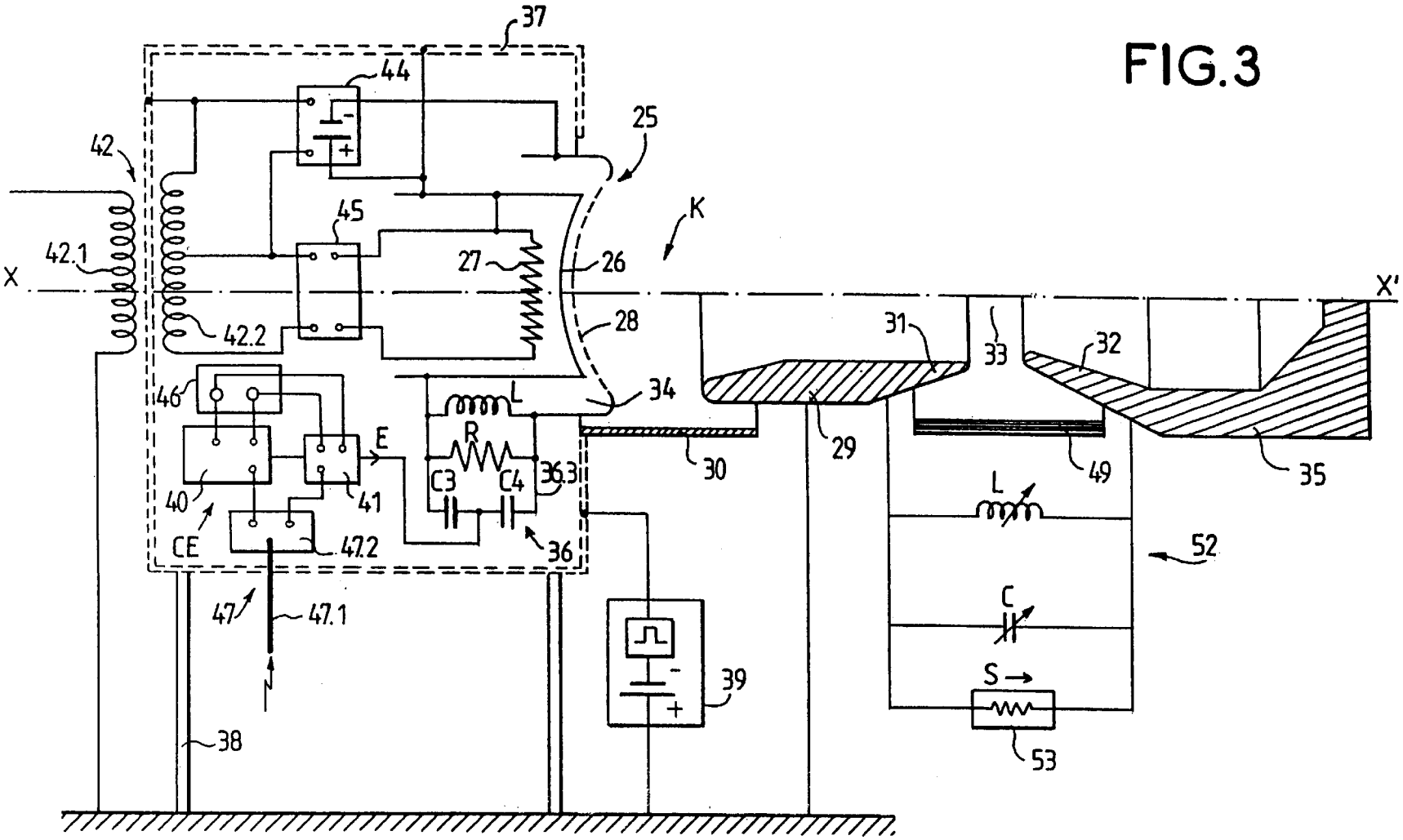
FIG. 3 shows a partial longitudinal section of a variant of a radiofrequency generator according to the invention.

The various characteristics of the generator according to the invention could be obtained with configurations other than those shown in FIGS. 2 and 3. In particular, other combinations of the configurations shown in FIGS. 2 and 3 are possible.

Figure 1:
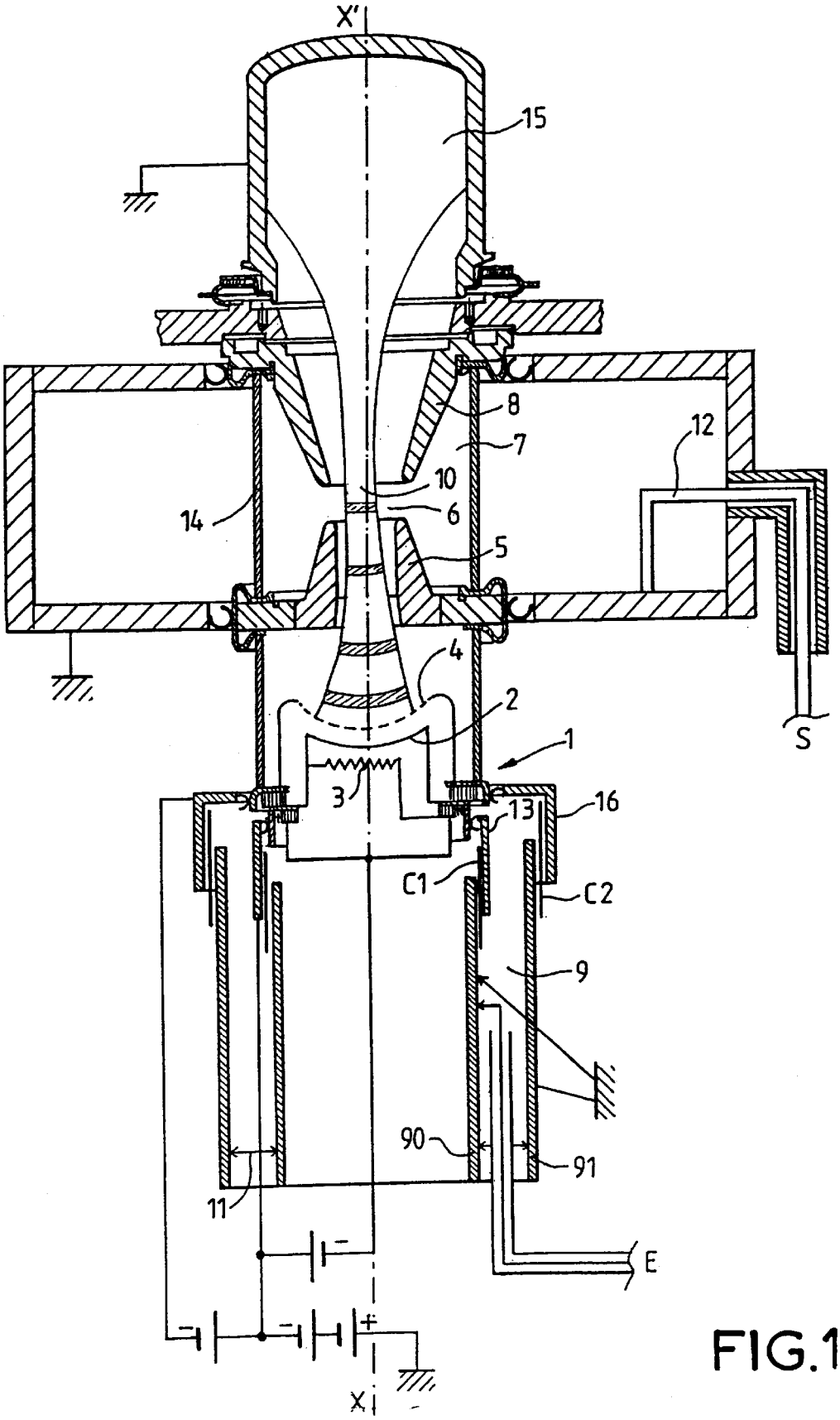
FIG. 1 (already described) shows a longitudinal section of an Inductive Output Tube (IOT) according to the prior art that can be used as a signal amplifier.

The radiofrequency generator according to the invention illustrated in FIGS. 2 and 3 includes means CE to produce an input radiofrequency signal E to be amplified and means 36 to feed it to an IOT referenced K which supplies an output signal S whose power is amplified compared with the input signal E. The IOT K bears some resemblance to the classical tube described with reference to FIG. 1. The gun 25 is found again with a cathode 26 equipped with a heater 27 and a grid 28 separated from the cathode 26. The function of the gun 25 is to emit an electron beam (not shown for reasons of clarity) via an anode 29 electrically isolated from the gun 25 by a dielectric sleeve 30. The anode 29 in the form of a drift tube ends with a lip 31 which, in combination with a second lip 32 placed opposite it, delimits a space 33 in which the electrons produced by the cathode 26 interact with the electromagnetic field that is established there. The second lip 32 is prolonged into a collector 35 that collects the electrons of the beam when they exit the interaction space 33. In this embodiment, there is electrical continuity between the second lip 32 and the collector 35. It would be possible to make the second lip 32 and the collector 35 electrically isolated from each other, as illustrated in FIG. 1.

The means of feeding the input radiofrequency signal E into the IOT K are provided by an input resonant circuit 36 coupled to the IOT's cathode/grid space 34. The means CE to produce the input signal E, the input resonant circuit 36 and the gun 25 are placed in an electrostatically screened enclosure 37, isolated electrically from the potential of the anode 29 of the IOT. This screened enclosure 37 is raised to a high voltage provided by a supply 39, this high voltage being intended for the gun 25 of the IOT; the gun 25 is raised to this high tension via the screened enclosure 37. The high voltage supply 39 is placed outside the enclosure 37.

The anode 29 is generally connected to the electrical ground (ground potential), so the screened enclosure 37 is electrically isolated from this ground by at least one dielectric support 38 which assures a low capacitance between the enclosure 37 and the ground. In FIG. 2, the electric isolation of the screened enclosure 37 with respect to the anode 29 is provided by two dielectric supports 38 which rest on the floor at the same potential that the anode. They then also have a mechanical function. The dielectric sleeve 30 also contributes to this isolation. Other configurations could be employed to isolated the screened enclosure 37 from the anode 29.

The means CE to produce the input signal E include a radiofrequency source 40 which feeds a preamplifier 41 whose output is connected to the input resonant circuit 36. The radiofrequency source 40 generates a low level signal in a desired frequency band and it is this low signal level, preamplified by the preamplifier 41, that provides the input radiofrequency signal E to be amplified in the IOT K. The preamplifier 41 can possibly be omitted if a radiofrequency source 40 of sufficient power is available. The preamplifier 41 can be solid state or of the vacuum tube type, for example including a flat triode; this depends on the frequency and the power of the input signal to be generated. The preamplifier 41 may have one or several amplification stages. Such preamplifiers are well known to professionals of the art.

The electric supply of the means CE producing the input radiofrequency signal E can be taken from the secondary 42.2 of at least one isolating transformer 42. The secondary 42.2 of the transformer is connected at one point to the screened enclosure 37 and its primary 42.1 is connected at one point to the ground. In this embodiment, the secondary 42.2 of the transformer is placed inside the screened enclosure 37 and the primary 42.1 is outside, but it would be possible to position the primary and secondary of the transformer differently. The primary 42.1 and the secondary 42.2 of the transformer 42 must be sufficiently insulated from each other to withstand the high tension applied to the screened enclosure 37.

The input resonant circuit 36 can be with distributed constants, in other words formed by a coaxial cavity including an internal cylinder 36.1 and an external cylinder 36.2; the internal cylinder 36.1 is connected electrically to the cathode 26 and the external cylinder 36.2 to the grid 28. The input signal E is transmitted to the grid/cathode space 34 by means of capacitive or inductive coupling 43 in the usual manner for IOTs or grid tubes. In FIG. 2, an inductive loop is shown, with its end in contact with the internal cylinder 36.1. This configuration is advantageous if the dimensions of the grid/cathode space 34 are relatively large compared with the wavelength of the signal to be amplified. If the dimensions of the grid/cathode space 34 are small compared with the wavelength of the signal to be amplified, then the input resonant circuit 36 can be with localized constants. This variant is illustrated in FIG. 3 which shows a parallel resonant circuit 36.3 represented by an RLC circuit fitted between the grid 28 and the cathode 26. There are several known means of coupling the means CE to produce the input signal E in the resonant circuit; the schema in FIG. 3 is just one example. The circuit 36.3 includes two capacitors C3, C4 in series; the output of the preamplifier 41 is connected to the common point between these two capacitors C3, C4.

The gun 25 is lowered to the negative voltage of the supply 39 by its cathode 26 which is connected to the screened enclosure 37. This voltage can be of the order of −300 kV.

The heating device 27 represented as a filament has one of its ends connected to the cathode. Its power comes from a power source 45 which cooperates with the secondary 42.2 of an isolating transformer 42, this secondary 42.2 being connected at one point to the screened enclosure 37. The primary 42.1 of the transformer is connected at one point to the electrical ground. This transformer 42 can be the same one as that used to supply the means CE producing the input signal, as illustrated in FIG. 2, but this is not obligatory (see FIG. 3). In the embodiments described here the secondary of the transformer is inside of the enclosure and the primary is outside, but other structures are possible.

The grid 28 is lowered to a more negative tension than that of the cathode by means of a polarization source 44 fitted between the grid and the cathode. The necessary power is supplied to this source 44 by the secondary 42.2 of an isolating transformer 42, this secondary being connected at one point to the screened enclosure 37. The primary 42.1 of the transformer is connected at one point to the ground.

In this embodiment, the transformer 42 supplies both the heating device 27 and the means CE to produce the input signal, but this is not obligatory. In this configuration, illustrated in FIG. 2, part of the secondary supplies the means CE producing the input signal, another part supplies the heating device 27 and yet another part supplies the grid 28.

If the generator according to the invention is intended to operate continuously, the high voltage supply 39 connected to the screened enclosure 37 is a DC supply. If the generator is intended to work in pulsed mode, the high voltage supply 39 delivers pulses of suitable duration. This characteristic is illustrated in FIG. 3. The output power of the radiofrequency generator is greater when operating in pulsed mode.

When the generator operates in pulsed mode, it is preferable that the supply of the means CE producing the signal E to be amplified is provided by at least one battery 46 placed within the screened enclosure 37, since the voltage pulses can generate parasitic signals appearing in the secondary 42.2 of the isolating transformer 42, with a risk of damage to the components of the radiofrequency source 40 or the preamplifier 41. This risk is avoided with a battery 46. This characteristic is illustrated in FIG. 3.

It is preferable to provide optical means 47 for control purposes within the enclosure 37, for example, to control the starting of the radiofrequency source 40 and/or the preamplifier 41 and/or the heating device 27, and/or to control the frequency of the radiofrequency source 40 and/or of the preamplifier if it is of the tube type. These means 47 make use of fiber optics 47.1 of which part penetrates and extends inside the screened enclosure 37. One end of the fiber 47.1 outside the enclosure receives a light signal which is transported to the other end within the screened enclosure. This other end is connected to a photosensitive device 47.2 which forms part of the corresponding control system. This device can be a photodiode which, when illuminated, closes a circuit to execute the desired command. For reasons of clarity, in the figure the photosensitive device 47.2 is shown connected only to the means CE producing the input signal. Such optical means 47 are totally insensitive to high voltages.

The output signal S of very high power is extracted from an output resonant circuit in the interaction space 33. In FIG. 2, the output resonant circuit is with distributed constants and takes the form of a resonant cavity 48 comparable to that shown in FIG. 1. Around the interaction space 33 there is a dielectric sleeve 49 connected on one side to the anode 29 and on the other side to the second lip 32. The output signal S is extracted by inductive coupling. For this purpose, a conducting loop 50 extends into the cavity 48 and makes contact with its wall. Outside the cavity 48, the energy collected by the loop 50 can be fed to an antenna (not shown) via a coaxial line 51 extending the loop 50.

Instead of the output resonant circuit being with distributed constants, it could be with localized constants. This variant is shown in FIG. 3. The output resonant circuit 52 is a parallel resonant circuit connected between the anode 29 and the second lip 32. This parallel resonant circuit 52 is represented by an LC circuit. The means of extraction of the output signal S are schematized by a load 53 connected in parallel with the output resonant circuit 52.

The resonant circuits included in the generator are adjusted to resonate at the desired frequency. In this category, we should not forget those of the means CE producing the input signal E which have not been described in detail. If any of the resonant circuits of the generator are with distributed constants, the frequency tuning can be achieved by modifying the resonance volume by known means involving displacement of the walls; these means are schematized by the double-ended arrow in FIG. 2. If other resonant circuits of the generator are with localized constants, the tuning is achieved by the choice of their components, such as variable inductors or capacitors. This characteristic is schematized in FIG. 3.

What is claimed is:

1. A radio frequency generator comprising:

an Inductive Output Tube (IOT) including, an anode, and an electron gun having a cathode and a grid, and configured to be raised to a high voltage with respect to the anode;

means for producing an input radio frequency signal;

a polarization source configured to provide a polarization voltage between said grid and said cathode; and means for transmitting said input radio frequency signal to said IOT such that said IOT provides an output signal whose power is amplified compared to said input signal, wherein said means for producing said input radio frequency signal, said means for transmitting said input radio frequency signal to said IOT, the polarization source, and said electron gun are confined within an electrostatically screening enclosure that is electrically isolated from a potential of the anode and is configured to raised to said high voltage, said electron gun being electrically connected to said screening enclosure for receiving said high voltage.

2. The generator according to claim 1, wherein said anode is connected to the electrical ground, and said screened enclosure rests on at least one dielectric support placed on a floor.

3. The generator according to claim 1 or claim 2, wherein said means for producing said input radio frequency signal include a radio frequency source feeding a preamplifier which generates said input radio frequency signal.

4. The generator according to claim 1, wherein said means for transmitting said input radio frequency signal to said IOT include an input resonant circuit connected between said grid and said cathode.

5. The generator according to claim 4, wherein said input resonant circuit is a coaxial resonant cavity delimited by an internal cylinder and an external cylinder, said internal cylinder being connected to said cathode, and said external cylinder being connected to said grid.

6. The generator according to claim 4, wherein said input resonant circuit is a parallel resonant circuit with localized constants, connected between said cathode and said grid.

7. The generator according to claim 1, wherein said means for producing the input radio frequency signal to be amplified draws power from a secondary of at least one isolating transformer, the secondary being connected at one point to said screened enclosure and a primary of said isolating transformer being connected at one point to a ground.

8. The generator according to claim 1, wherein said means for producing said input radio frequency signal to be amplified receives an electrical supply from at least one battery located within said screened enclosure.

9. The generator according to claim 1, wherein said gun of said IOT includes a cathode; and a grid, wherein said cathode is connected electrically to said screened enclosure.

10. The generator according to claim 9, wherein said grid is polarized relative to said cathode by a polarization source placed in said screened enclosure.

11. The generator according to claim 9, wherein said cathode is equipped with a heating device connected to said cathode.

12. The generator according to claim 9, wherein said cathode is equipped with a heating device configured to receive power from a secondary of an isolating transformer, the secondary being connected at one point to said screened enclosure and a primary of said isolating transformer being connected at one point to a ground.

13. The generator according to claim 7, wherein said isolating transformer supplying said means for producing said input radio frequency signal and said transformer supplying said heating device are the same transformer.

14. The generator according to claim 1, wherein the anode includes an end which takes the form of a first lip which, in combination with a second lip placed opposite to the first lip, delimits an interaction space for electrons produced by said gun, and said interaction space is coupled to an output resonant circuit from which said output signal is extracted.

15. The generator according to claim 14, wherein said output resonant circuit is a resonant cavity.

16. The generator according to claim 14, wherein said output resonant circuit is a parallel resonant circuit with localized constants.

17. The generator according to claim 1, including optical control means penetrating inside said screened enclosure.

18. A radio frequency generator comprising:

an Inductive Output Tube (IOT) including, an anode, and an electron gun having a cathode and a grid, and configured to be raised to a high voltage with respect to the anode;

means for producing an input radio frequency signal;

means for transmitting said input radio frequency signal to said IOT such that said IOT provides an output signal whose power is amplified compared to said input signal; and a source of a pulsed high voltage, wherein said means for producing said input radio frequency signal, said means for transmitting said input radio frequency signal to said IOT, and said electron gun are confined within an electrostatically screening enclosure that is electrically isolated from a potential of the anode and that is connected to said source of a pulsed high voltage, said electron gun being electrically connected to said screening enclosure for receiving said pulsed high voltage.

* * * * *